US010408535B2

(12) United States Patent
Egoshi

(10) Patent No.: US 10,408,535 B2
(45) Date of Patent: Sep. 10, 2019

(54) MULTISTAGE BATH CONDENSER-REBOILER

(71) Applicant: TAIYO NIPPON SANSO CORPORATION, Tokyo (JP)

(72) Inventor: Nobuaki Egoshi, Yokohama (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 293 days.

(21) Appl. No.: 15/502,250

(22) PCT Filed: Aug. 21, 2015

(86) PCT No.: PCT/JP2015/073553
§ 371 (c)(1),
(2) Date: Feb. 7, 2017

(87) PCT Pub. No.: WO2016/027889
PCT Pub. Date: Feb. 25, 2016

(65) Prior Publication Data

US 2017/0227284 A1 Aug. 10, 2017

(30) Foreign Application Priority Data

Aug. 22, 2014 (JP) ..... 2014-169825

(51) Int. Cl.
*F25J 3/04* (2006.01)
*F25J 5/00* (2006.01)

(52) U.S. Cl.
CPC ..... *F25J 3/04412* (2013.01); *F25J 3/04212* (2013.01); *F25J 3/04884* (2013.01); *F25J 5/00* (2013.01); *F25J 5/005* (2013.01); *F25J 2250/02* (2013.01); *F25J 2250/10* (2013.01); *F25J 2290/32* (2013.01)

(58) Field of Classification Search
CPC ..... F25J 3/04412; F25J 3/04212; F25J 5/00; F25J 5/005; F25J 3/04884; F25J 2290/32; F25J 2250/10; F25J 2250/02
See application file for complete search history.

(56) References Cited

U.S. PATENT DOCUMENTS 4,606,745 A 8/1986 Fujita
2003/0159810 A1 8/2003 Schweigert et al.

FOREIGN PATENT DOCUMENTS

CN 1165286 11/1997
JP 60-253782 12/1985
(Continued)

OTHER PUBLICATIONS

Search Report issued in CN Appln. No. 201580044530.9 dated Aug. 30, 2018 (w/ partial translation).
(Continued)

*Primary Examiner* — Ana M Vazquez
(74) *Attorney, Agent, or Firm* — Nixon & Vanderhye P.C.

(57) ABSTRACT

A multistage bath condenser-reboiler according to the present invention includes:

a heat exchanger core composed of (i) a heat exchange section formed by adjacently stacking condensation passages and evaporation passages, and (ii) a liquid communication section formed from liquid communication passages provided on at least one side surface in the stacking height direction of the heat exchange section; and one or more stages of liquid reservoir sections formed on at least one side surface in the width direction of the heat exchanger core.

9 Claims, 14 Drawing Sheets

(56) References Cited

FOREIGN PATENT DOCUMENTS

| | | |
|---|---|---|
| JP | 3-007879 | 1/1991 |
| JP | 6-257981 | 9/1994 |
| JP | 2003-535301 | 11/2003 |

OTHER PUBLICATIONS

International Search Report for PCT/JP2015/073553, dated Oct. 13, 2015, 2 pages.
Extended European Search Report dated Feb. 20, 2018 issued in European Application No. 15834547.0 (9 pages).

MULTISTAGE BATH CONDENSER-REBOILER

TECHNICAL FIELD

The present invention relates to a bath condenser-reboiler in which the liquid inside liquid reservoirs provided in at least two evaporation zones is introduced into evaporation passages, and a resulting thermosiphoning effect induced by heat exchange with a gas flowing through a condensation passage is used to evaporate the liquid and condense the gas.

This application is the U.S. national phase of international Application No. PCT/JP2015/073553 filed Aug. 21, 2015, which designated the U.S. and claims priority to Japanese Patent Application No. 2014-169825, filed Aug. 22, 2014, the entire contents of each of which are hereby incorporated by reference.

BACKGROUND ART

A bath condenser-reboiler induces indirect heat exchange between liquefied oxygen from the bottom of a low-pressure distillation column (hereafter referred to as "the low-pressure column") and nitrogen gas from the top of a high-pressure distillation column (hereafter referred to as "the high-pressure column") in a cryogenic air separation unit by a double column system. As a result of this process, the bath condenser-reboiler generates a rising gas in the low-pressure column through evaporation and gasification of a portion of the liquefied oxygen, and generates a reflux liquid in both columns through condensation and liquefaction of the nitrogen gas.

Common among such bath condenser-reboilers are those that use plate-fin heat exchanger cores. These plate-fin heat exchanger cores have large numbers of heat exchange passages formed from adjacent condensation passages and evaporation passages via parting sheets, and are immersed in a liquid bath, and are formed such that the condensation fluid (nitrogen gas) introduced as a gas undergoes condensation and liquefaction in the condensation passages by indirect heat exchange with the evaporation fluid (liquefied oxygen) in the liquid bath and flows downward through the heat exchanger core, while a portion of the liquefied oxygen introduced into the evaporation passages from the bottom of the heat exchanger core undergoes evaporation and gasification and flows upward trough the heat exchanger core.

The flow into the evaporation passages from bottom and the upward flow occur because evaporation causes the liquid density to be lower than the density inside the liquid bath (a thermosiphoning effect), but because the heat exchanger core is used fully immersed in liquefied oxygen, the liquid head of the liquefied oxygen causes the flow into the heat exchanger core to occur at a lower temperature than the boiling point. The liquid head is expressed as the pressure converted to a liquid height. Accordingly, not only is a certain core height required until boiling begins, but the increase in temperature to the boiling point means the temperature difference with the nitrogen gas of the condensed fluid cannot be ensured, causing the pressure of the nitrogen gas to rise and increasing operating costs.

To resolve this problem caused by the liquid head of the liquefied oxygen, Patent Document 1 discloses a multistage bath condenser in which the evaporation zone is partitioned vertically into multiple zones, and multiple stages of liquid reservoir are provided to hold the liquefied oxygen in each evaporation zone, thereby reducing increases in boiling point and improving efficiency. When the liquid reservoir is provided in multiple stages, means for connecting the liquid reservoirs in each evaporation zone and supplying liquefied oxygen to each liquid reservoir are required. In relation to this point, in Patent Document 1, as illustrated in FIG. 1 and FIG. 4 of Patent Document 1, liquid reservoir sections to hold liquid are provided on one or both surfaces in the width direction of the heat exchanger core, and means for connecting the liquid reservoir sections so that the liquid can be supplied to each liquid reservoir are provided.

PRIOR ART LITERATURE

Patent Documents

Patent Document 1: Published Japanese Translation No. 2003-535301 of PCT

DISCLOSURE OF INVENTION

Problems to be Solved by the Invention

However, in the multistage bath condenser of Patent Document 1, a problem arises in that the reservoir sections on the outside surface of the heat exchanger core and the liquid communication means are complex, resulting in high manufacturing costs.

The present invention has been developed in light of the above problem, and has an object of providing a multistage bath condenser-reboiler that can be produced with a compact size by employing a simple construction for the liquid reservoirs provided in the heat exchanger core and the means by which the liquid reservoirs are connected.

Means for Solving the Problems

In order to achieve the above object, the inventors of the present invention conceived of incorporating, into the heat exchanger core, means that enable the liquid reservoir sections to communicate and supply liquid to each liquid reservoir section. The present invention is based on this concept, and includes the specific aspects described below.

(1) A multistage bath condenser-reboiler according to the present invention includes: condensation passages which communicate in the vertical direction and through which a gas flows and condenses, evaporation passages which are partitioned into multiple stages through which a liquid flows that undergoes heat exchange with the gas and evaporates, one or more stages of liquid reservoir sections which hold liquid supplied to and discharged from the evaporation passages, and liquid communication passages through which the liquid in the liquid reservoir sections flows from upper liquid reservoir sections to lower liquid reservoir sections, wherein the multistage bath condenser-reboiler has:

a heat exchanger core composed of (i) a heat exchange section formed by adjacently stacking the condensation passages and the evaporation passages formed from plates and fins, and (ii) a liquid communication section formed from the liquid communication passages provided on at least one side surface in the stacking height direction of the heat exchange section, and one or more stages of the liquid reservoir sections formed on at least one side surface in the width direction of the heat exchanger core so as to correspond with the number of stages of the evaporation passages.

(2) In the evaporation passages are formed evaporation inlet flow channels which introduce the liquid in the liquid reservoir sections into the partitioned evaporation passages, and evaporation outlet flow channels which discharge a rising vapor-liquid two-phase fluid into the liquid reservoir sections, whereas in the liquid communication passages are formed communicating inlet flow channels which introduce the liquid in the liquid reservoir sections into the liquid communication passages and communicating outlet flow channels from which liquid flows out into the liquid reservoir section beneath.

(3) Further, in the multistage bath condenser-reboiler according to (2) above, the inlet of the communicating inlet flow channel is provided at a position below the position of the outlet of the evaporation outlet flow channel.

(4) Furthermore, in the multistage bath condenser-reboiler according to (2) above, the height position of the inlet of the evaporation inlet flow channel is offset with respect to the height position of the outlet of the communicating outlet flow channel.

(5) Further, in the multistage bath condenser-reboiler according to any of (1) to (4) above, each of the liquid reservoir sections is an enclosed space, and in each liquid reservoir section is provided an evaporation gas extraction port through which the evaporated gas that flows out to the liquid reservoir section is extracted.

(6) Furthermore, in the multistage bath condenser-reboiler according to (5) above, in the liquid reservoir section, in the uppermost liquid reservoir section is provided a liquid inlet port into which liquid is introduced from outside the device, and in the lowermost liquid reservoir section is provided a liquid discharge port from which liquid is discharged externally.

(7) Further, in the multistage bath condenser-reboiler according to any of (1) to (4) above, the liquid reservoir sections are open, and the condenser-reboiler further includes a gas collection vessel that collects the evaporated gas that flows out into the liquid reservoir sections.

(8) Furthermore, in the multistage bath condenser-reboiler according to any of (1) to (7) above, the liquid reservoir sections are provided on both sides in the width direction of the heat exchanger core.

(9) Furthermore, in the multistage bath condenser-reboiler according to any of (1) to (8) above, the liquid communication passages are provided on both side surfaces in the stacking height direction of the heat exchanger core.

Effects of the Invention

In the multistage bath condenser-reboiler according to the present invention, a configuration is employed that includes:

a heat exchanger core composed of (i) a heat exchange section formed by adjacently stacking the evaporation passages and condensation passages formed from plates and fins and (ii) liquid communication sections formed from the liquid communication passages provided on at least one side surface in the stacking height direction of the heat exchanger section, and one or more stages of liquid reservoir sections formed on at least one side surface in the width direction of the heat exchanger core so as to correspond with the number of stages of the evaporation passages. As a result, the structure is simple compared with a conventional condenser in which the communication means are formed from pipes, enabling a more compact design.

Furthermore, by employing this configuration, the heat exchanger core can be manufactured as an integral unit, thereby reducing manufacturing costs.

BEST MODE FOR CARRYING OUT THE INVENTION

Preferred embodiments of the present invention are described below, but, the present invention is not limited to the embodiments below. Various additions, omissions, substitutions and other changes may be made provided that they do not depart from the scope of the present invention.

Embodiment 1

Figure 1:
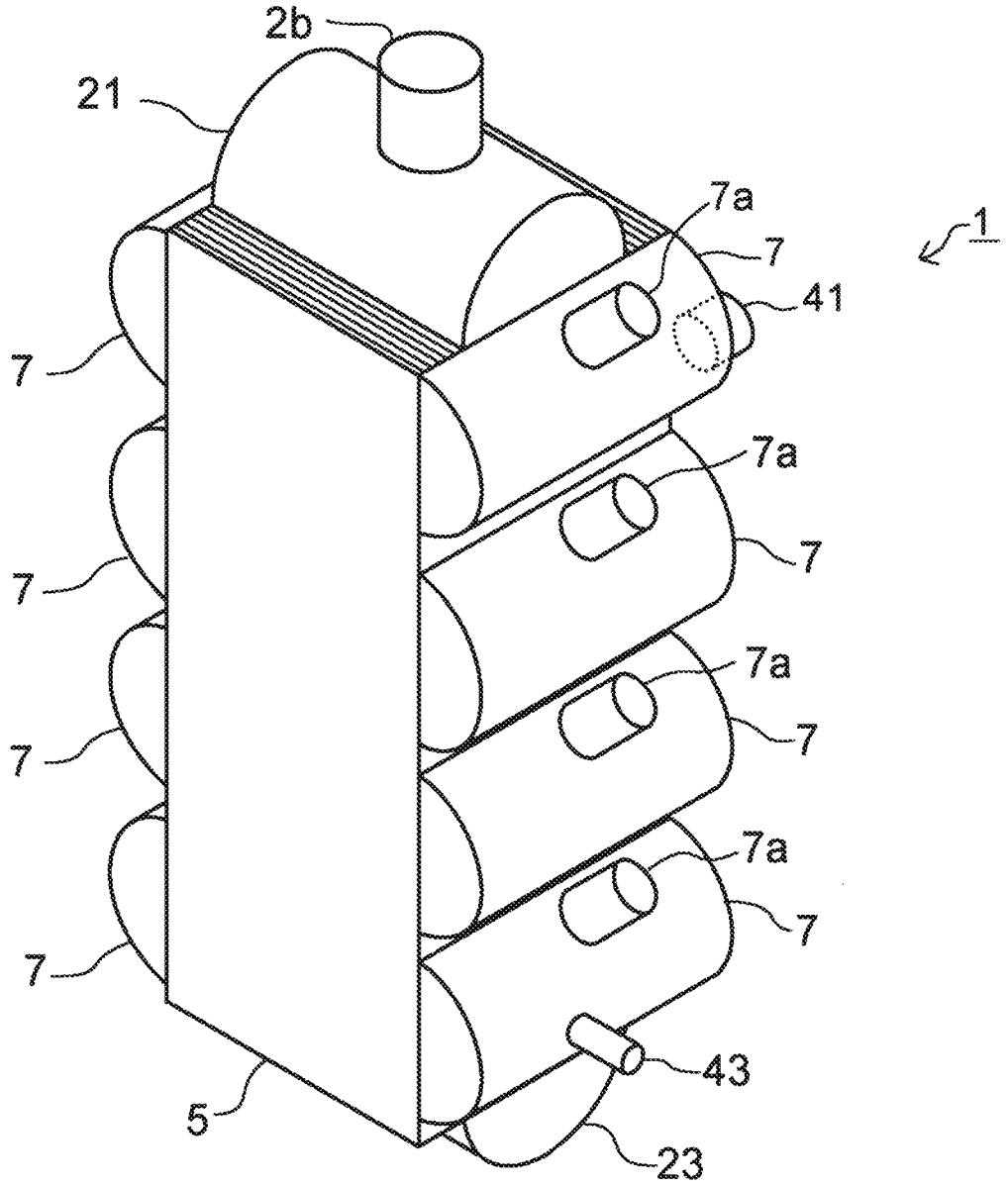
FIG. 1 is a perspective view of a multistage bath condenser-reboiler according to an embodiment of the present invention.
Figure 2:
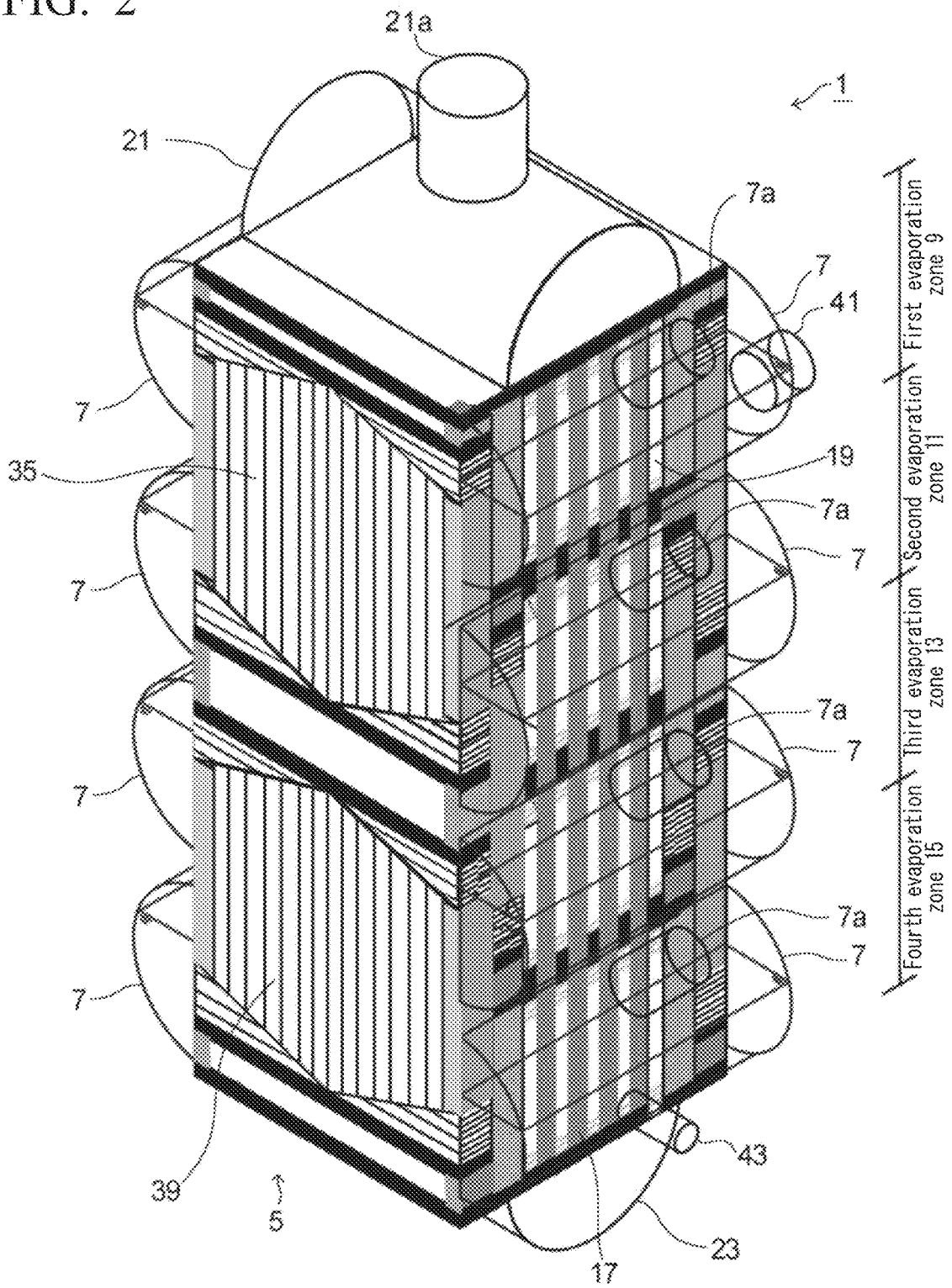
FIG. 2 is a partially transparent perspective view of a multistage bath condenser-reboiler according to an embodiment of the present invention.
Figure 3:
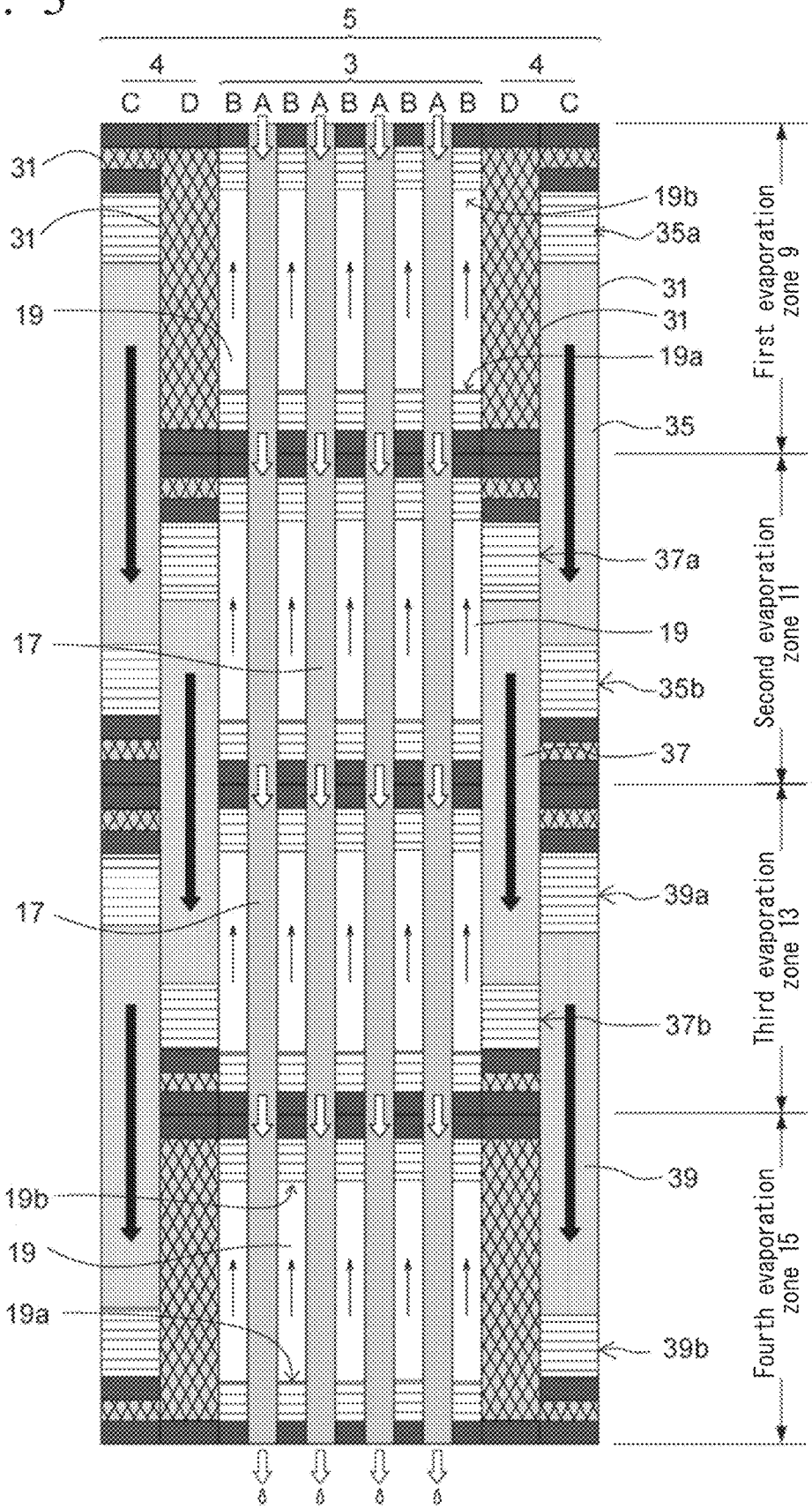
FIG. 3 is a function explanation diagram of the core of a multistage bath condenser-reboiler according to an embodiment of the present invention.

As illustrated in FIG. 1 and FIG. 2, a multistage bath condenser-reboiler 1 according to one embodiment of the present invention includes, for example, four evaporation zones aligned in the vertical direction (in order from the top, a first evaporation zone 9 to a fourth evaporation zone 15). Here, an evaporation zone refers to a zone in which heat exchange is performed between a gas and a liquid, causing the liquid to evaporate. As illustrated in FIG. 3, the multistage bath condenser-reboiler 1 includes:

a heat exchanger core 5, which is composed of (i) a heat exchange section 3 and (ii) liquid communication sections 4 formed from a first liquid communication passage 35 to a third liquid communication passage 39 provided on both side surfaces of the heat exchange section 3 in the stacking height direction, and multiple stages of a liquid reservoir section 7 formed on both sides in the width direction of the heat exchanger core 5.

Each part of this structure is described below in detail. In the following description, an example is used in which the multistage bath condenser-reboiler 1 is used as the main condenser in a cryogenic air separation unit that condenses nitrogen gas and evaporates liquid oxygen by inducing heat exchange between the nitrogen gas and the liquid oxygen.

<Heat Exchange Section>

The heat exchange section 3 is a device that causes heat exchange between the liquid oxygen and nitrogen gas flowing therein, thereby condensing the nitrogen gas and evaporating the liquid oxygen, and is composed of condensation passages 17 and evaporation passages 19 stacked adjacent to each other.

In the present embodiment, as illustrated in FIG. 3, the heat exchange section 3 is formed by stacking four layers of condensation passages (A) and five layers of evaporation passages (B).

Figure 5:
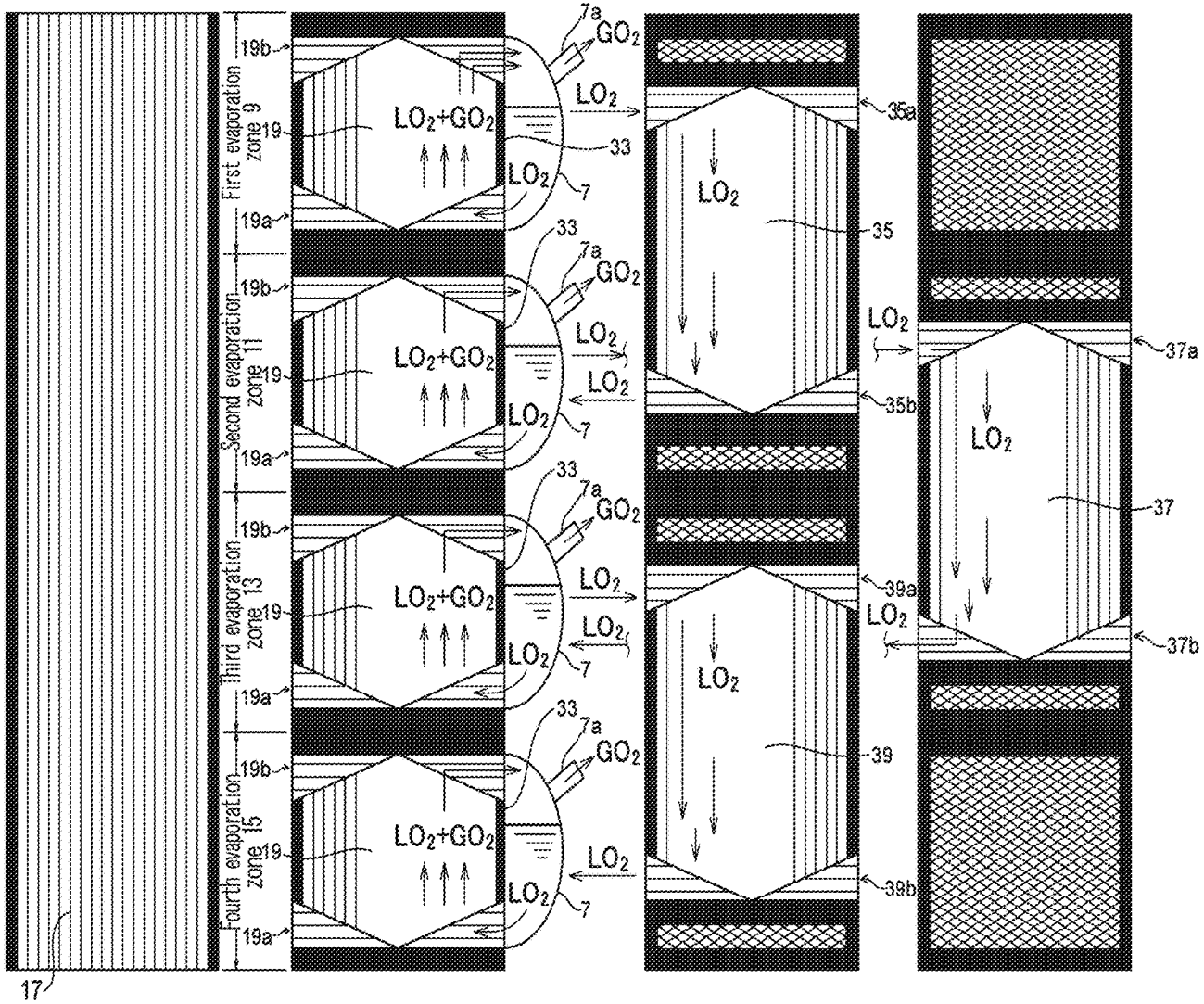
FIG. 5 is an explanatory diagram of the passages that form a multistage bath condenser-reboiler core according to an embodiment of the present invention.
Figure 6:
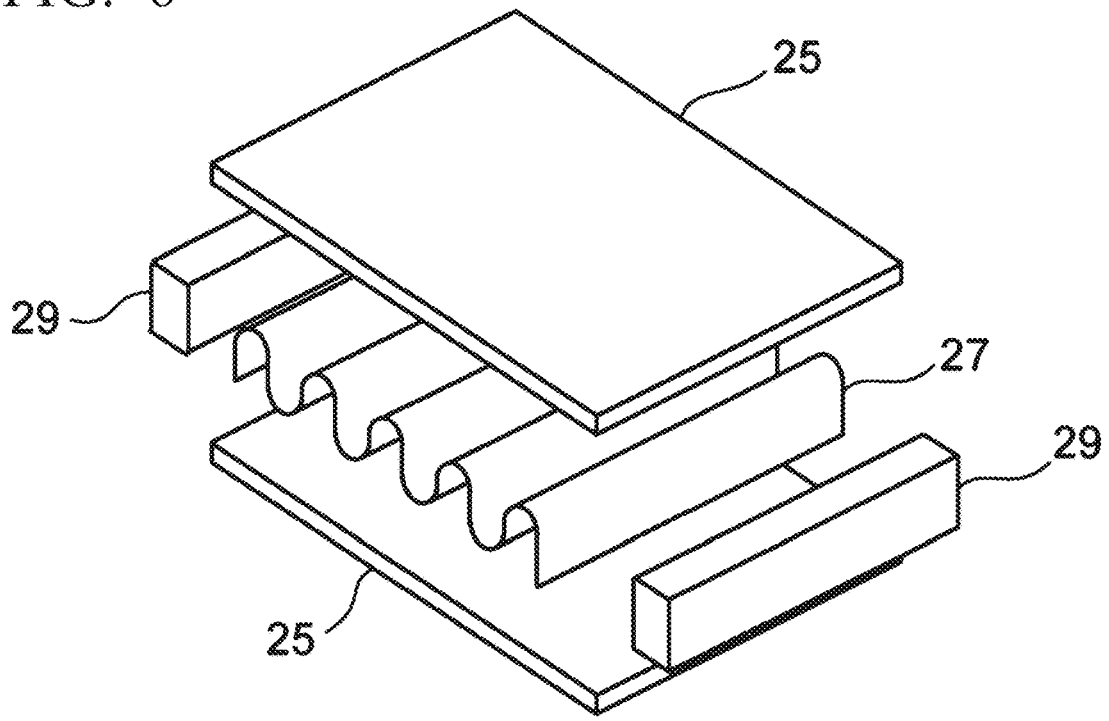
FIG. 6 is an explanatory diagram (1 of 2) of the basic structure of a multistage bath condenser-reboiler core according to an embodiment of the present invention.
Figure 7:
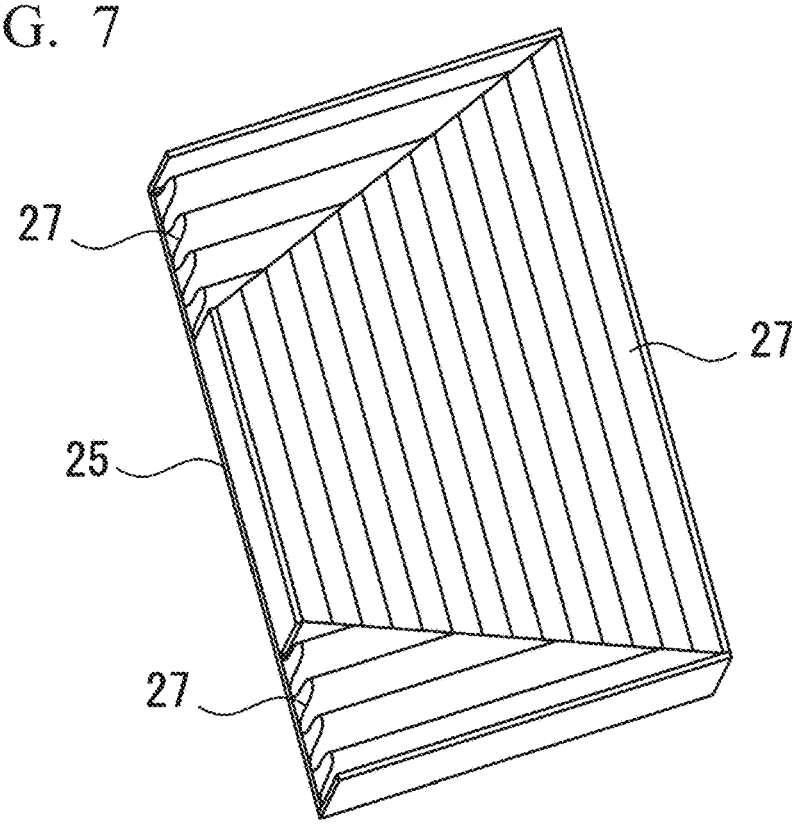
FIG. 7 is an explanatory diagram (2 of 2) of the basic structure of a multistage bath condenser-reboiler core according to an embodiment of the present invention.

As illustrated in FIG. 6, the condensation passages 17 and evaporation passages 19 have a so-called plate fin type configuration formed by stacking plates 25 (parting sheets), fins 27 (corrugation fins), and side bars 29 or the like. The plates 25 and fins 27 form flow channels, and the side bars 29 partition these flow channels while also having a reinforcing function. In FIG. 3 and FIG. 5, the side bars 29 are shaded black. The direction of flow in the flow channels formed by stacking the plates 25 and fins 27 is determined by the orientation of the fins 27. By combining multiple fins 27 in different orientations, flow channels that flow in various directions can be formed, and as illustrated in FIG. 7 for example, by combining vertically oriented fins 27 and horizontally oriented fins 27, flow channels can be formed that flow from a horizontal direction to a vertical direction, and then from a vertical direction to a horizontal direction.

The condensation passages 17 are formed using vertically oriented fins, and as illustrated in FIG. 3 or FIG. 5, the flow channels are formed so as to communicate from the top end surface of the heat exchanger core 5 to the bottom end surface. The nitrogen gas flows in from the top ends of the condensation passages 17, cools as is passes through the inside of the condensation passages, and flows out from the bottom ends as liquid nitrogen.

As illustrated in FIG. 3 and FIG. 5, the evaporation passages 19 are provided independently in each evaporation zone, and as illustrated in FIG. 5, are formed by arranging fins that are oriented horizontally relative to the width direction of the heat exchanger core 5 and fins that are oriented vertically and communicate with the horizontally oriented fins. The liquid oxygen held in the liquid reservoir section 7 of each evaporation passage 19 flows in from an evaporation inlet flow channel 19*a* formed from the lower horizontally oriented fins, rises along the vertically oriented fins while evaporating, and is returned to the liquid reservoir section 7 in the form of a vapor-liquid two-phase fluid through evaporation outlet flow channels 19*b* formed from the upper horizontally oriented fins.

As illustrated in FIG. 2, at the top end of the heat exchanger core 5, a nitrogen gas header 21 is provided which distributes the nitrogen gas to the plurality of condensation passages 17, and a nitrogen gas inlet pipe 21*a* is provided on the nitrogen gas header 21.

Furthermore, as illustrated in FIG. 2, at the bottom end of the heat exchanger core 5, a liquid nitrogen header 23 is provided which collects the liquid nitrogen condensed in the condensation passages 17, and the liquid nitrogen collected in the liquid nitrogen header 23 is extracted through a liquid nitrogen extraction pipe not shown in the figure.

<Liquid Communication Section>

The first liquid communication passage 35 to third liquid communication passage 39 form a liquid communication section 4, and are provided on both sides in the stacking height direction of the heat exchange section 3. As illustrated in FIG. 3, the second liquid communication passage 37 is formed from plates 31 and fins in layers D on the side surfaces of the heat exchange section 3, and the first liquid communication passage and third liquid communication passage are formed further on the outward side of the second liquid communication passage 37 by providing fins and plates 31 in layers C.

FIG. 5 illustrates an example of the fin configuration of the first liquid communication passage 35 to third liquid communication passage 39 which, in a similar manner to the evaporation passages, combine vertically oriented fins and horizontally oriented fins.

For the sake of simplicity, FIG. 5 omits some of the lines that represent the vertically oriented fins. Fins with low pressure loss (for example, fins with a larger pitch) are preferably used as the fins in the first liquid communication passage 35 to third liquid communication passage 39 to allow the liquid oxygen to flow down smoothly.

The first liquid communication passage 35 is a passage that communicates from the first evaporation zone 9 to the second evaporation zone 11, and the third liquid communication passage 39 is a passage that communicates from the third evaporation zone 13 to the fourth evaporation zone 15, with both of these communication passages formed in the layer C. Furthermore, the second liquid communication passage 37 is a passage that communicates from the second evaporation zone 11 to the third evaporation zone 13, and is formed in the layer D.

In the layers C and D which constitute the liquid communication section 4, parts that do not function as passages (dummy passages) are formed, and these dummy passages are indicated by crosshatching in FIG. 3 and FIG. 5.

At the top of the first and third liquid communication passages 35 and 39 are formed a first communicating inlet flow channel 35*a* and a third communicating inlet flow channel 39*a* respectively, each formed from horizontally oriented fins into which liquid oxygen is introduced from the liquid reservoir sections 7 of the first and third evaporation zones 9 and 13 respectively. At the bottom of the first and third liquid communication passages 35 and 39 are formed a first communicating outlet flow channel 35*b* and a third communicating outlet flow channel 39*b* respectively, each formed from horizontally oriented fins that guide liquid oxygen to the liquid reservoir sections 7 of the second and fourth evaporation zones 11 and 15 respectively.

In a similar manner, a second communicating inlet flow channel 37*a* is formed at the top of the second liquid communication passage 37, and a second communicating outlet flow channel 37*b* is formed at the bottom of the second liquid communication passage 37.

In this manner, because a liquid communication section composed of the first liquid communication passage 35 to third liquid communication passage 39 can be formed by providing plates 31 and fins on the side surfaces of the heat exchange section 3, the structure can be made more simple and compact than conventional condensers in which communication means passages are composed of piping.

Furthermore, by using the configuration described above, the liquid communication sections 4 and the heat exchange section 3 can be manufactured integrally as a plate fin type heat exchanger core 5. Specifically, the heat exchanger core 5 can be produced by assembling the plates 25, the fins 27 and the side bars 29 of the heat exchange section 3 and the liquid communication sections 4 that constitute the heat exchanger core 5 (as illustrated in FIG. 6), and then vacuum brazing the resulting assembly in a furnace.

Furthermore, because the communication channel sections 4 of the first liquid communication passage 35 to third liquid communication passage 39 are provided on the outside surfaces of the heat exchange section 3 rather than the inside surfaces, heat exchange with the fluid in the condensation passages 17 can be avoided.

Figure 4:
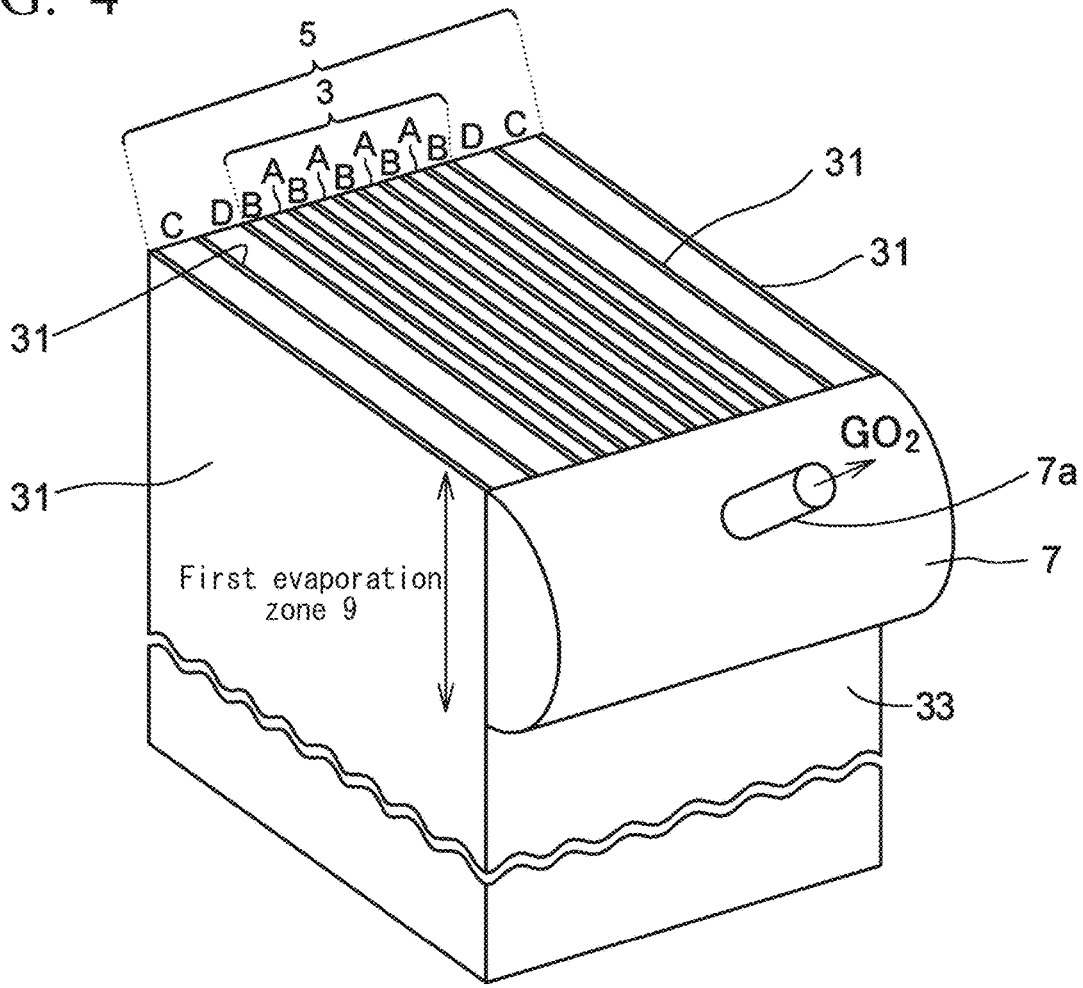
FIG. 4 is an explanatory diagram of the structure of a multistage bath condenser-reboiler according to an embodiment of the present invention.

In the example illustrated in FIG. 3 and FIG. 4, liquid communication sections 4 may be provided on one or both sides of the heat exchange section 3. Providing liquid communication sections 4 on both sides allows the liquid oxygen to flow downward more smoothly.

The entire throughput flow of liquid oxygen is supplied to the liquid reservoir section 7 of the first evaporation zone 9, and because a substantially equivalent amount is evaporated in each evaporation zone, the flow rate through the communication passages decreases in order from the first liquid communication passage 35 to the second liquid communication passage 37 and then the third liquid communication passage 39. Accordingly, the size of the opening of the inlet (communicating inlet flow channel) of each communication passage is changed to provide the same fluid resistance, thereby realizing a uniform liquid head in each liquid reservoir.

<Liquid Reservoir Section>

A liquid reservoir section 7 is provided in each evaporation zone on at least one side surface of the heat exchanger core 5 in the width direction. In the present example, as illustrated in FIG. 1 and FIG. 2, liquid reservoir sections 7 are provided in each evaporation zone on both side surfaces of the heat exchanger core 5 in the width direction, and each liquid reservoir section is an enclosed space. In FIG. 5, the liquid reservoir sections 7 on one side of the heat exchanger core 5 are not illustrated in the drawing.

A liquid inlet port 41 through which a liquid (liquid oxygen) can be introduced from outside the device is provided on the liquid reservoir section 7 of the first evaporation zone 9, and a liquid discharge port 43 through which a liquid (liquid oxygen) can be discharged externally is provided on the liquid reservoir section 7 of the fourth evaporation zone 15 (see FIG. 2).

Furthermore, the liquid reservoir sections 7 also function as collectors of oxygen gas, and an evaporation gas extraction port 7*a* is provided in each liquid reservoir section 7 for the purpose of extracting the evaporated gas (oxygen gas) that flows out to the reservoir section (see FIG. 2).

[Description of Operation of Multistage Bath Condenser-Reboiler]

A method for performing heat exchange between nitrogen gas and liquid oxygen using the multistage bath condenser-reboiler 1 of the configuration described above is described below, together with a description of the operation of the multistage bath condenser-reboiler 1.

Liquid oxygen is introduced from outside the device via the liquid inlet port 41 and accumulates in the liquid reservoir section 7 of the first evaporation zone 9. On the other hand, nitrogen gas is introduced into the condensation passages 17 via the nitrogen gas header 21.

Head pressure causes the liquid oxygen accumulated in the liquid reservoir section 7 to flow into the evaporation passage 19 from the evaporation inlet flow channel 19*a*, and the liquid surface levels inside the liquid reservoir section 7 and the evaporation passage 19 reach the same height.

When nitrogen gas passes through the condensation passages 17 in this state, heat exchange occurs between the nitrogen gas and the liquid oxygen in the evaporation passage 19, a portion of the liquid oxygen undergoes evaporation and gasification to become oxygen gas, and the liquid oxygen in the evaporation passage 19 becomes a gas-liquid mixture (vapor-liquid two-phase fluid). Due to the difference in density from the liquid oxygen inside the liquid reservoir section 7, a rising flow is generated in the evaporation passage 19 and is discharged from the evaporation outlet flow channel 19*b* as a vapor-liquid two-phase fluid. The discharged evaporated oxygen gas is extracted from the evaporation gas extraction port 7*a* of the liquid reservoir section 7, and the liquid oxygen that did not evaporate returns to the liquid reservoir section 7, forming a circulating flow between the liquid reservoir section 7 and the evaporation passage 19 (a thermosiphoning effect).

When the liquid surface level in the liquid reservoir section 7 reaches or exceeds the height of the first communicating inlet flow channel 35*a*, the liquid oxygen flows from the first communicating inlet flow channel 35*a* into the first communication passage 35, is discharged from the first communicating outlet flow channel 35*b*, and accumulates in the liquid reservoir section 7 of the second evaporation zone.

Once liquid oxygen has accumulated in the liquid reservoir section 7 of the second evaporation zone 11, then in a similar manner to the first evaporation zone 9, the liquid oxygen flows from the evaporation inlet flow channel 19*a* into the evaporation passage 19 and is discharged from the evaporation outlet flow channel 19*b* as a vapor-liquid two-phase fluid, and when the liquid surface level in the liquid reservoir section 7 reaches or exceeds the height of the second communicating inlet flow channel 37*a*, the liquid oxygen flows into the second communication flow channel 37 and enters the liquid reservoir section 7 of the lower-stage third evaporation zone 13 via the second communicating outlet flow channel 37*b*.

The flow of liquid oxygen from the third evaporation zone 13 into the fourth evaporation zone 15 occurs in a similar manner. The liquid oxygen that accumulates in the liquid reservoir section 7 of the fourth evaporation zone 15 is extracted via the liquid discharge port 43 so that the liquid surface level remains constant.

On the other hand, the nitrogen gas undergoes heat exchange with the liquid oxygen in the adjacent evaporation passages 19 while passing through the condensation passages 17, condenses (is liquefied) and flows down from the bottom end of the condensation passages 17, and is extracted via the liquid nitrogen header 23 and the liquid nitrogen extraction pipe.

As is apparent from this description of the operation of the device, because a vapor-liquid two-phase fluid is discharged from the evaporation outlet flow channel 19*b* to the liquid reservoir section 7, it is preferable that the liquid surface level of the liquid reservoir section 7 is below the evaporation outlet flow channel 19*b* so as not to impede this discharge. Accordingly, the heights of the communicating inlet flow channels (the first communicating inlet flow channel 35*a*, the second communicating inlet flow channel 37*a* and the third communicating inlet flow channel 39*a*) in each evaporation zone are preferably set lower than the evaporation outlet flow channels 19*b*.

In the liquid reservoir sections 7, in the vicinity of the evaporation inlet flow channels 19*a*, the liquid oxygen flows from the liquid reservoir section 7 toward the inward direction of the heat exchanger core 5, whereas in the vicinity of the communicating outlet flow channels (the first communicating outlet flow channel 35*b*, the second communicating outlet flow channel 37*b* and the third communicating outlet flow channel 39*b*), the liquid oxygen flows from the heat exchanger core 5 toward the liquid reservoir section 7. Accordingly, if the evaporation inlet flow channel 19*a* and the communicating outlet flow channels are near each other, there is a possibility that the opposing flows may interfere with each other, causing stagnation in the flow, and therefore the evaporation inlet flow channel 19*a* and the communicating outlet flow channels are preferably placed as far apart as possible. For example, the height position of the evaporation inlet flow channel 19*a* may be displaced relative to the height position of the communicating outlet flow channels.

It is particularly preferable that the height position of the evaporation inlet flow channel 19*a* is lower than the height position of the communicating outlet flow channels. By employing such a configuration, the liquid oxygen can still flow into the evaporation inlet flow channel 19*a* in situations such as at startup when little liquid oxygen has accumulated in the liquid reservoir section 7,

[Example of use of Multistage Bath Condenser-Reboiler]

Figure 8:
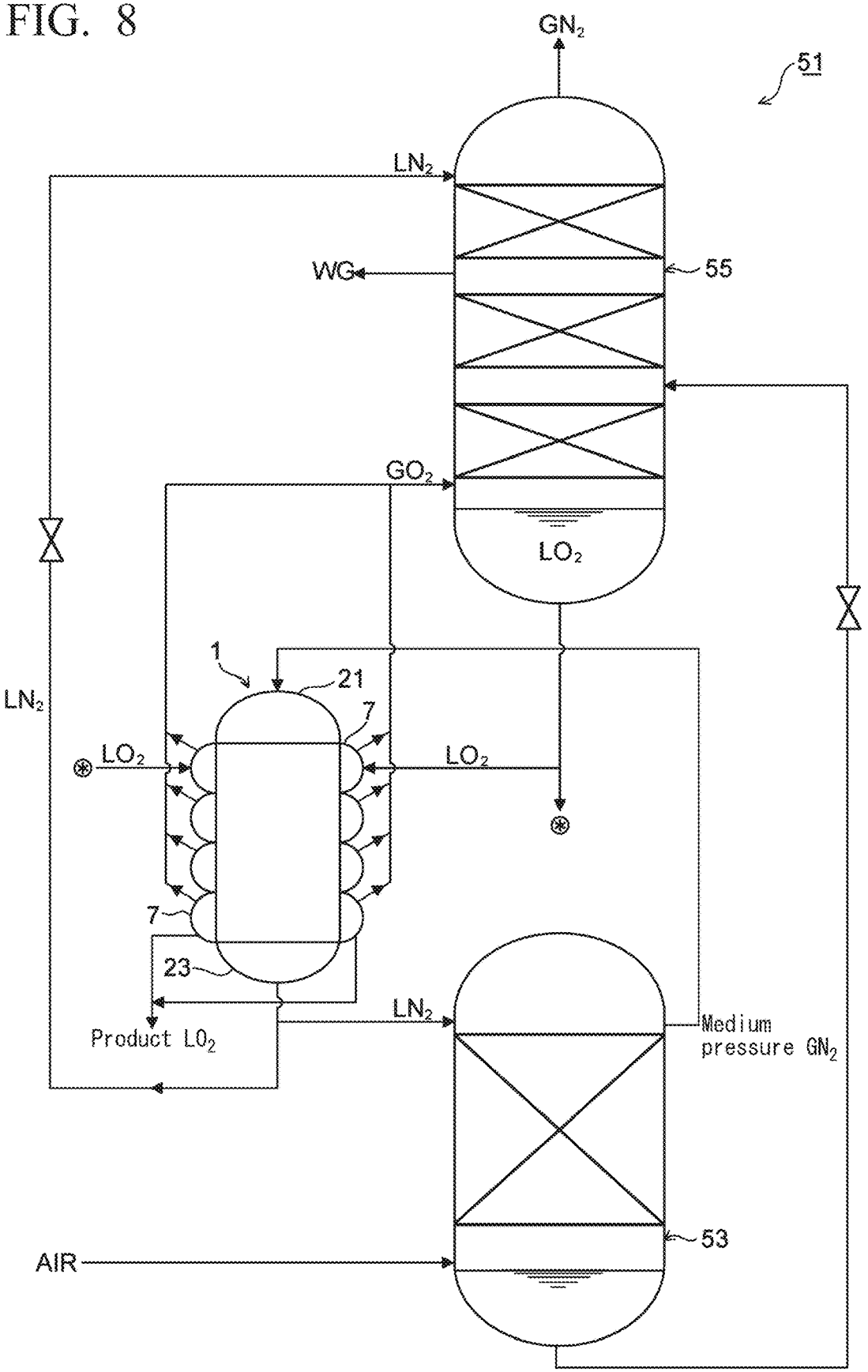
FIG. 8 is an explanatory diagram of a cryogenic air separation unit that employs a multistage bath condenser-reboiler according to an embodiment of the present invention.

FIG. 8 illustrates an example of using the multistage bath condenser-reboiler 1 of the above configuration as the main condenser in a cryogenic air separation unit 51.

FIG. 8 illustrates an example in which a high-pressure column 53 and a low-pressure column 55 are provided as separate devices units, and the device illustrated in FIG. 1 is used as the main condenser. Components in FIG. 8 that are the same as those illustrated in FIG. 1 are assigned the same reference signs. The high-pressure column 53 is operated at, for example, an internal pressure of 6.0 bar, and the low-pressure column 55 is operated at, for example, an internal pressure of 1.4 bar. Feed air is supplied in the high-pressure column 53, and through distillation, oxygen-enriched liquid is produced at the bottom of the column and nitrogen gas is produced at the top of the column. All or some of this nitrogen gas is supplied to the multistage bath condenser-reboiler 1, undergoes condensation and liquefaction, and is supplied to the tops of the high-pressure column and the low-pressure column as a reflux liquid.

In the low-pressure column 55, as a result of distillation of the oxygen-enriched liquid in the bottom of the high-pressure column as the main raw material, low-pressure nitrogen gas is produced at the top of the column and liquid oxygen is produced at the bottom of the column, and this liquid oxygen is supplied to the multistage bath condenser-reboiler 1, undergoes evaporation and gasification, and is returned to the bottom of the low-pressure column as a rising gas.

Figure 9:
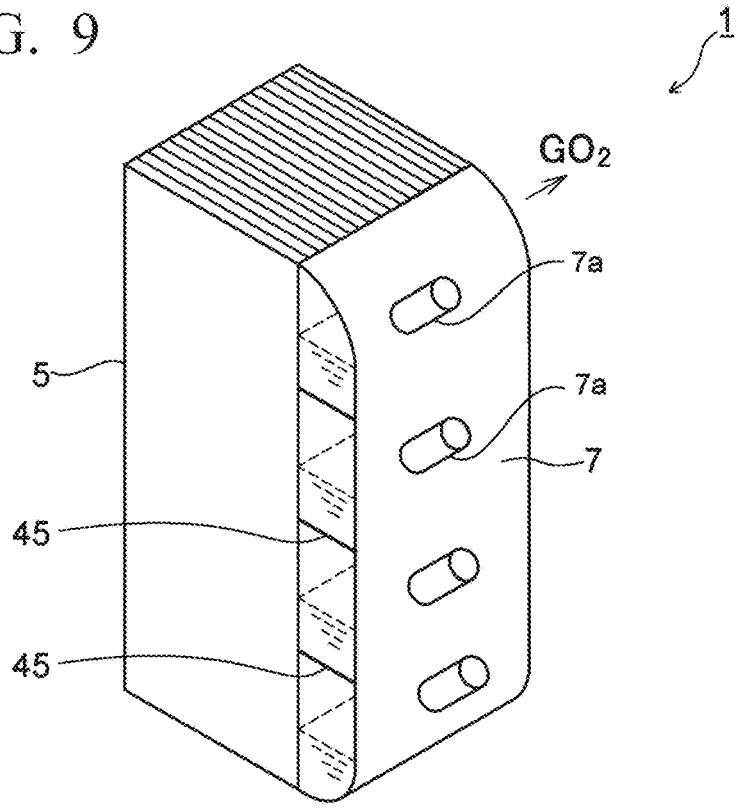
FIG. 9 is an explanatory diagram of another aspect of a liquid reservoir section of a multistage bath condenser-reboiler according to an embodiment of the present invention.
Figure 10:
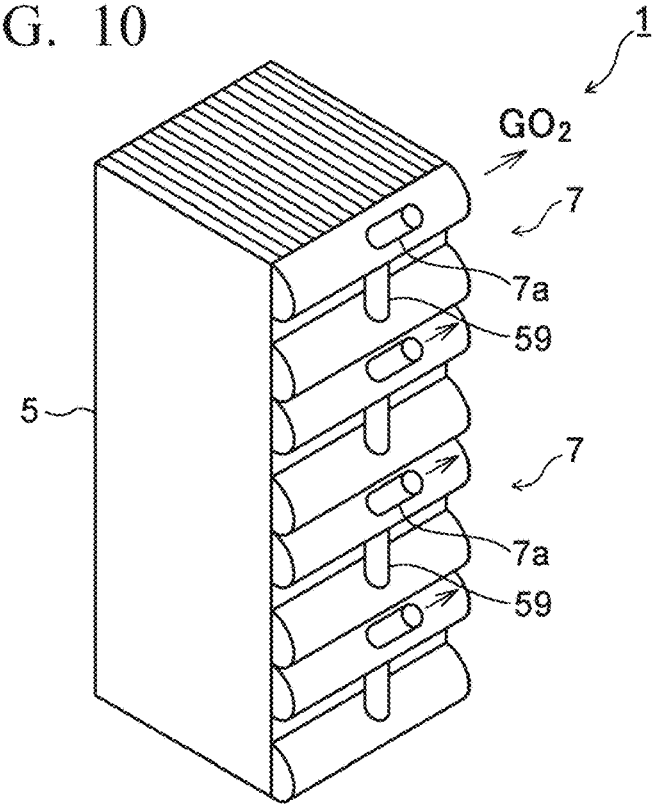
FIG. 10 is an explanatory diagram of yet another aspect of a liquid reservoir section of a multistage bath condenser-reboiler according to an embodiment of the present invention.

In the above description, as illustrated in FIG. 1, FIG. 2 and FIG. 5, an example was described in which a dome-shaped liquid reservoir section 7 was formed in each evaporation zone. However, for example, as illustrated in FIG. 9, the interior of the liquid reservoir section 7 may be demarcated by partition plates 45. Alternatively, as illustrated in FIG. 10, a configuration may be used in which dome-shaped headers are used which individually cover the evaporation inlet flow channel 19*a* and communicating outlet flow channel, and the evaporation outlet flow channel 19*b* and communicating inlet flow channel (see FIG. 5) in each liquid reservoir section 7 in each evaporation zone, with the headers connected to each other by connecting pipes 59. By employing this construction, the liquid reservoir section 7 can be made more compact.

Embodiment 2

Figure 11:
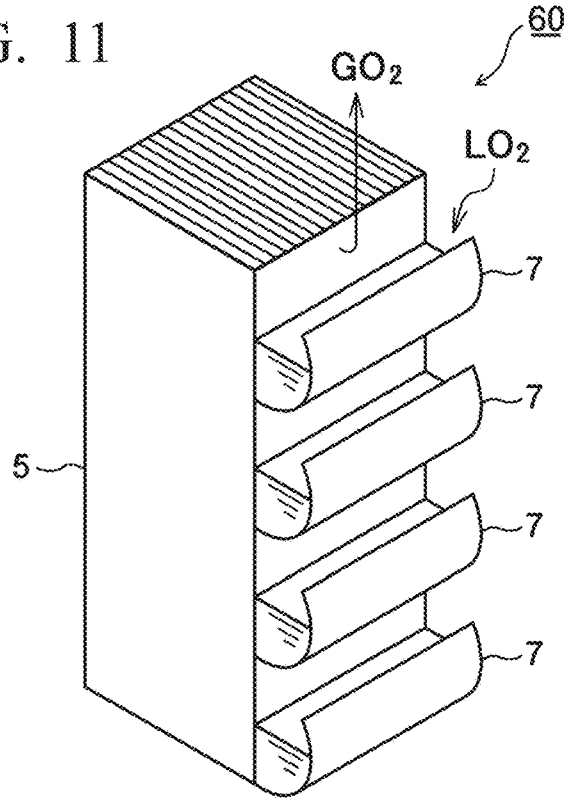
FIG. 11 is an explanatory diagram of a liquid reservoir section of a multistage bath condenser-reboiler according to another embodiment of the present invention.
Figure 12:
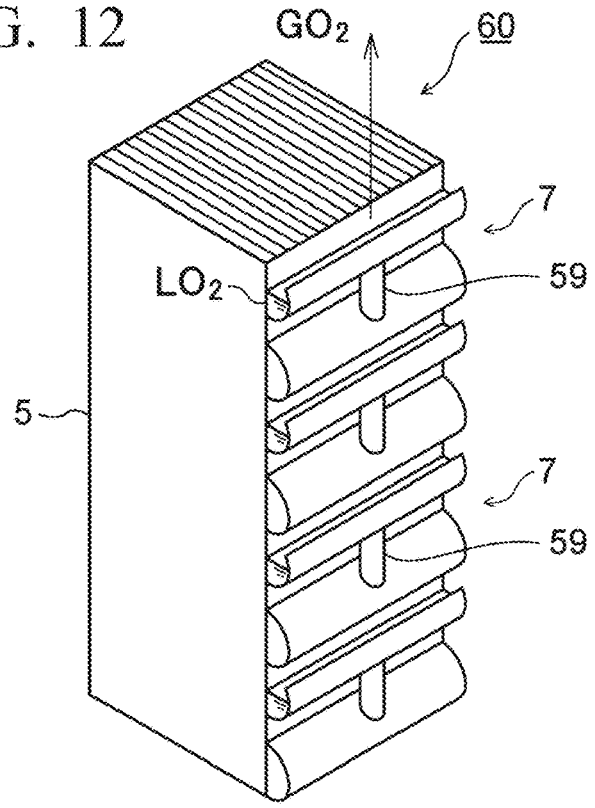
FIG. 12 is an explanatory diagram of another aspect of a liquid reservoir section of a multistage bath condenser-reboiler according to another embodiment of the present invention.

In the above description, an example was described in which the liquid reservoir sections 7 have the roles of storing liquid oxygen and of collecting oxygen gas, but the liquid reservoir section 7 need not necessarily have the role of collecting oxygen gas. Examples of such configurations are shown in FIG. 11 and FIG. 12. FIG. 11 illustrates a modification of the embodiment shown in FIG. 1, and FIG. 12 illustrates a modification of the embodiment shown in FIG. 10. Both are open-type multistage bath condenser-reboilers 60 in which the liquid reservoir sections 7 are open at the top.

Components in FIG. 11 and FIG. 12 that are the same as those in FIG. 1 and FIG. 10 are assigned the same reference signs.

Figure 13:
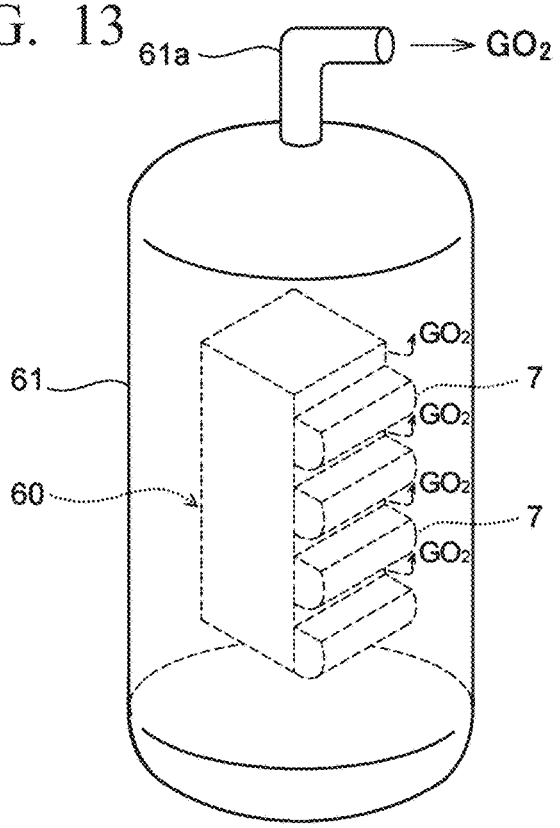
FIG. 13 is an explanatory diagram (1 of 2) of a gas collection vessel of a multistage bath condenser-reboiler according to another embodiment of the present invention.

As illustrated in FIG. 13, the open-type multistage bath condenser-reboiler 60 is placed in a gas collection vessel 61 that covers the multistage bath condenser-reboiler 60 in its entirety, so that the evaporated gas (oxygen gas) that flows out to the liquid reservoir sections collects in the gas collection vessel 61.

Figure 14:
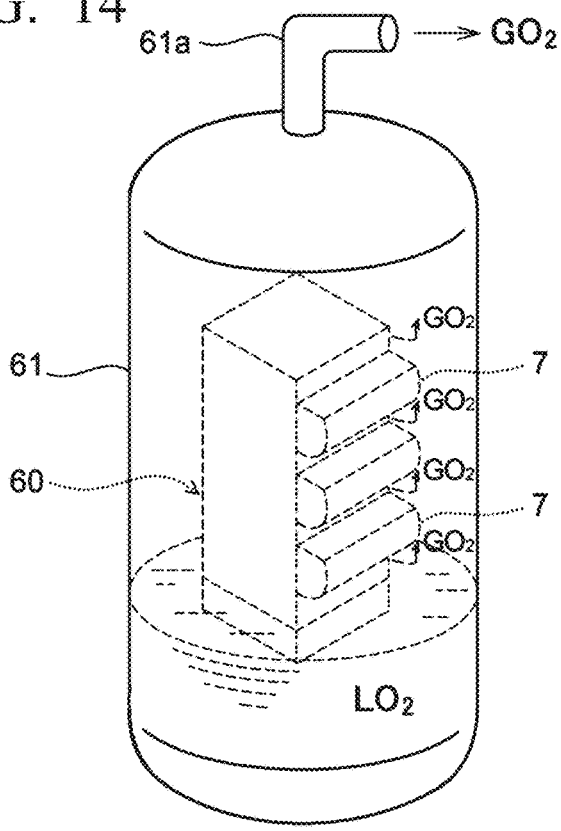
FIG. 14 is an explanatory diagram (2 of 2) of a gas collection vessel of a multistage bath condenser-reboiler according to another embodiment of the present invention.

Furthermore, in the case of the devices shown in FIG. 11 and FIG. 12, the liquid reservoir section 7 may be omitted from the lowest-stage evaporation zone, allowing the liquid oxygen to collect in the gas collection vessel 61 as illustrated in FIG. 14. In this case, as illustrated in FIG. 15, it is preferable that in the lowest-stage evaporation zone, the evaporation inlet flow channels 19*a* are provided on the bottom end surfaces of the evaporation passages B, and it is particularly preferable that the liquid nitrogen header 23 is provided on the side surface of the bottom end of the condensation passages A, as illustrated in FIG. 16 for example.

Figure 17:
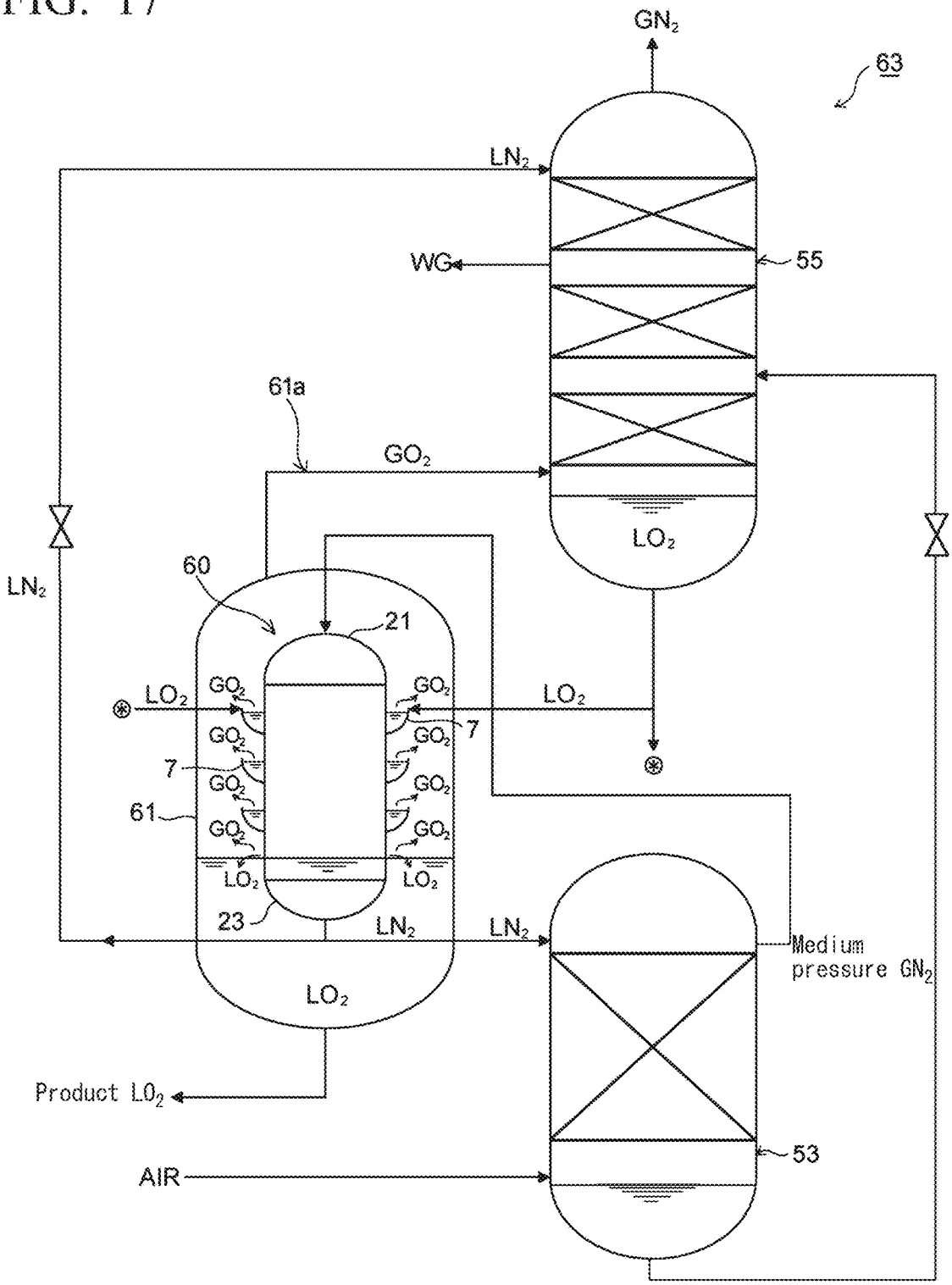
FIG. 17 is an explanatory diagram of a cryogenic air separation unit that employs a multistage bath condenser-reboiler according to another embodiment of the present invention.

FIG. 17 illustrates a cryogenic air separation unit 63 that uses an open-type multistage bath condenser-reboiler 60 such as that described above as the main condenser.

Figure 15:
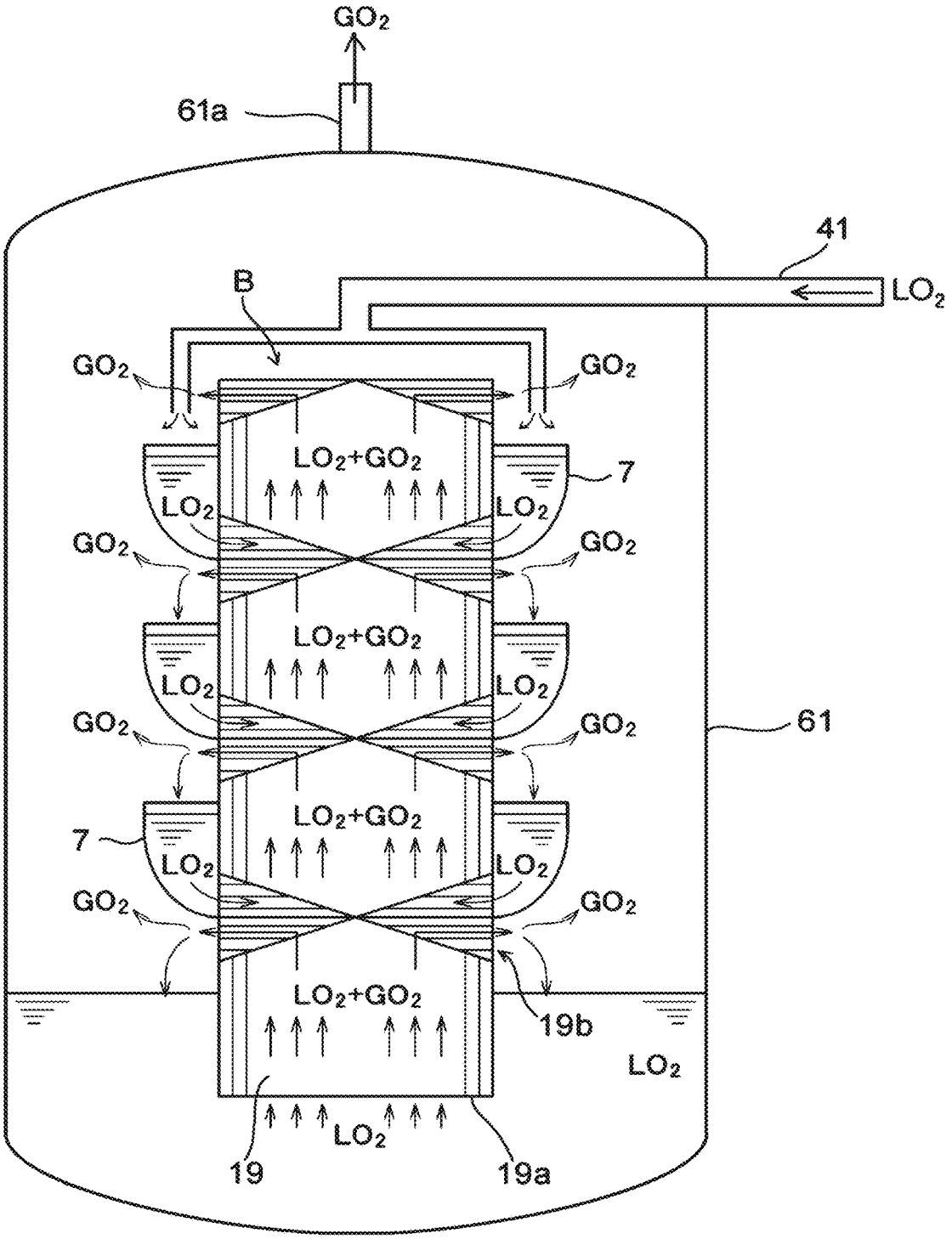
FIG. 15 is an explanatory diagram (1 of 2) of another aspect of a multistage bath condenser-reboiler core according to another embodiment of the present invention.
Figure 16:
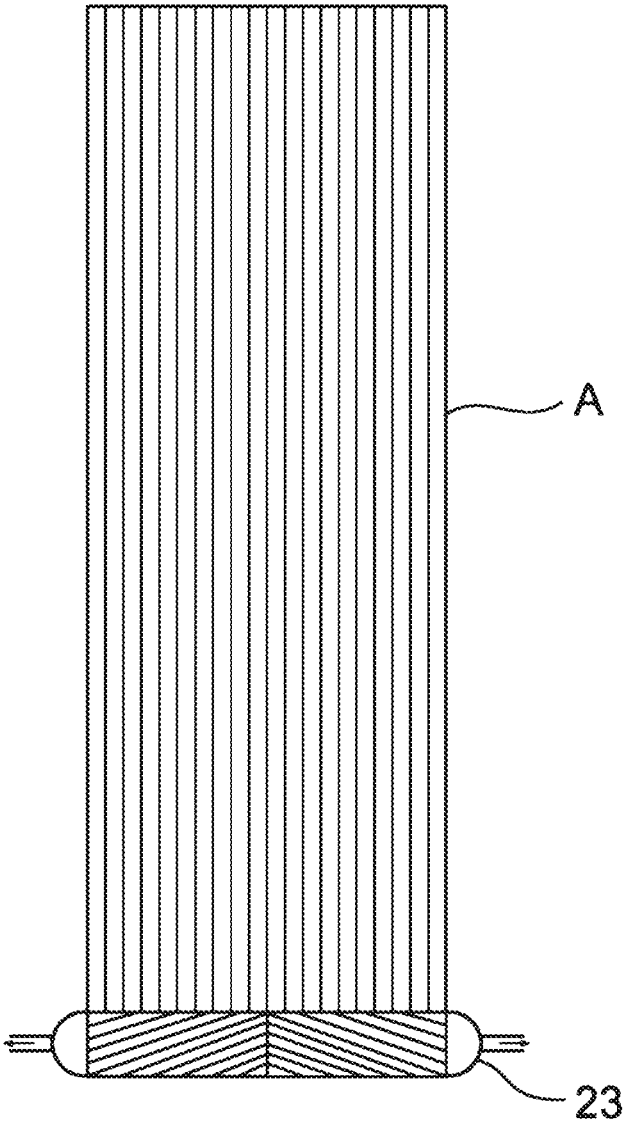
FIG. 16 is an explanatory diagram (2 of 2) of another aspect of a multistage bath condenser-reboiler core according to another embodiment of the present invention.

The cryogenic air separation unit 63 is a modification of the cryogenic air separation unit 51 illustrated in FIG. 8, and uses the device illustrated in FIG. 15 as the main condenser. Components in FIG. 17 that are the same as those in FIG. 8 are assigned the same reference signs. In this case, the multistage bath condenser-reboiler 60 is housed within the gas collection vessel 61, oxygen gas is extracted from the top of the gas collection vessel 61 through an extraction pipe

61*a* and supplied to the low-pressure column 55, and liquid oxygen is extracted from the bottom of the gas collection vessel 61 as a product.

Figure 18:
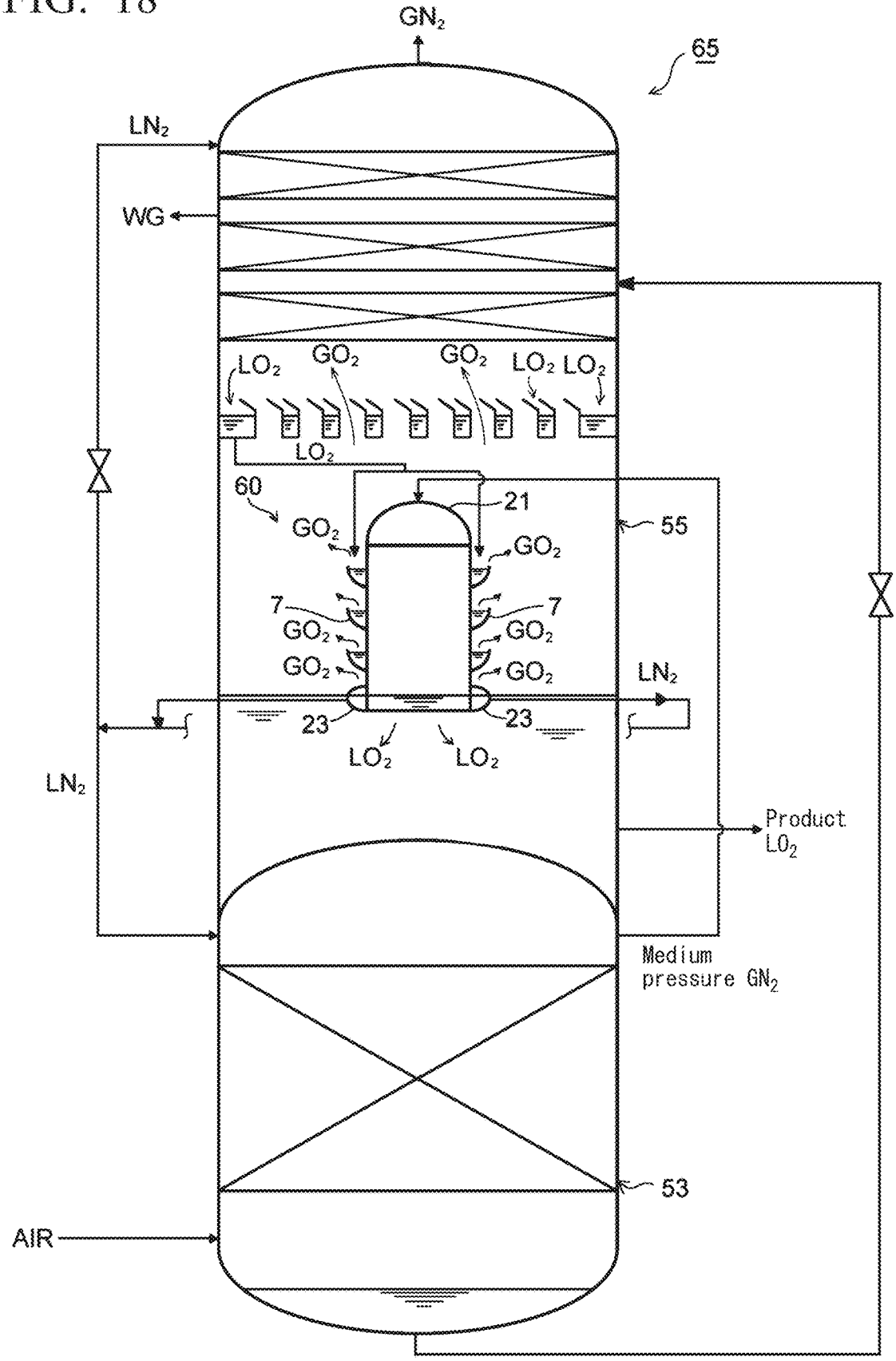
FIG. 18 is an explanatory diagram of another aspect of a cryogenic air separation unit that employs a multistage bath condenser-reboiler according to another embodiment of the present invention.

FIG. 18 illustrates a cryogenic air separation unit 65 as another aspect of a cryogenic air separation unit that uses the open-type multistage bath condenser-reboiler 60. In the air liquefaction and separation device 65, the high-pressure column 53 and the low-pressure column 55 are constructed as a single integrated device, and the multistage bath condenser-reboiler 60 is housed in the sump of the low-pressure column 55. Components in FIG. 18 that are the same as those in FIG. 8 and FIG. 17 are assigned the same reference signs. In this case, the bottom section of the low-pressure column 55 serves the role of a gas accumulation vessel (for accumulating liquid oxygen and collecting oxygen gas).

In the embodiment 1 and the embodiment 2 described above, an example was described in which, because four stages of evaporation zones were provided, a first liquid communication passage 35 through to a third liquid communication passage 39 were formed, but the number, shape and other attributes of the liquid communication passages may be changed as required in accordance with the number of evaporation zones.

INDUSTRIAL APPLICABILITY

A multistage bath condenser-reboiler can be obtained in which the liquid reservoirs provided in the condensation evaporator core and the means by which the liquid reservoirs communicate have a simple construction, enabling a compact design.

DESCRIPTION OF THE REFERENCE SIGNS

Layer A Condensation passage
Layer B Evaporation passage
Layer C Liquid communication passage
Layer D Liquid communication passage
1 Multistage bath condenser-reboiler (embodiment 1)
3 Heat exchange section
4 Liquid communication section
5 Heat exchanger core
7 Liquid reservoir section
7*a* Evaporation gas extraction port
9 First evaporation zone
11 Second evaporation zone
13 Third evaporation zone
15 Fourth evaporation zone
17 Condensation passage
19 Evaporation passage
19*a* Evaporation inlet flow channel
19*b* Evaporation outlet flow channel
21 Nitrogen gas header
21*a* Nitrogen gas inlet port
23 Liquid nitrogen header
25 Plate
27 Fin
29 Side bar
31 Passage formation plates
35 First liquid communication passage
35*a* First communicating inlet flow channel
35*b* First communicating outlet flow channel
37 Second liquid communication passage
37*a* Second communicating inlet flow channel
37*b* Second communicating outlet flow channel
39 Third liquid communication passage
39*a* Third communicating inlet flow channel
39*b* Third communicating outlet flow channel
41 Liquid inlet port
43 Liquid discharge port
45 Partition plate
51 Cryogenic air separation unit
53 High-pressure column
55 Low-pressure column
59 Connecting pipe
60 Multistage bath condenser-reboiler (embodiment 2)
61 Gas collection vessel
61*a* Extraction pipe
63 Cryogenic air separation unit (other aspect)
65 Cryogenic air separation unit (yet another aspect)

The invention claimed is:

1. A multistage bath condenser-reboiler, comprising:

condensation passages which communicate in a vertical direction and through which a gas flows and condenses, evaporation passages which are partitioned into multiple stages through which a liquid flows that undergoes heat exchange with the gas and evaporates, one or more stages of liquid reservoir sections which hold liquid supplied to and discharged from the evaporation passages, and liquid communication passages through which the liquid in the liquid reservoir sections flows from upper liquid reservoir sections to lower liquid reservoir sections, wherein the multistage bath condenser-reboiler comprises:

a heat exchanger core comprising (i) a heat exchange section formed by adjacently stacking the condensation passages and the evaporation passages formed from plates and fins, and (ii) a liquid communication section formed from the liquid communication passages provided on at least one side surface in a stacking height direction of the heat exchange section, and one or more stages of the liquid reservoir section formed on at least one side surface in a width direction of the heat exchanger core so as to correspond with a number of stages of the evaporation passages.

2. The multistage bath condenser-reboiler according to claim 1, wherein in the evaporation passages are formed evaporation inlet flow channels through which the liquid in the liquid reservoir sections is introduced into the partitioned evaporation passages, and evaporation outlet flow channels which discharge a rising vapor-liquid two-phase fluid into the liquid reservoir sections, and in the liquid communication passages are formed communicating inlet flow channels which introduce the liquid in the liquid reservoir sections into the liquid communication passages, and communicating outlet flow channels from which liquid flows out into a lower liquid reservoir section.

3. The multistage bath condenser-reboiler according to claim 2, wherein an inlet of the communicating inlet flow channel is provided at a position below a position of an outlet of the evaporation outlet flow channel.

4. The multistage bath condenser-reboiler according to claim 2, wherein a height position of an inlet of the evaporation inlet flow channel is offset with respect to a height position of an outlet of the communicating outlet flow channel.

5. The multistage bath condenser-reboiler according to claim 1, wherein each liquid reservoir section is an enclosed space, and in each liquid reservoir section is provided an evaporation gas extraction port through which evaporated gas that flows out to the liquid reservoir section is extracted.

6. The multistage bath condenser-reboiler according to claim 5, wherein, in the liquid reservoir section, in an uppermost liquid reservoir section is provided a liquid inlet port into which liquid is introduced from externally, and in a lowermost liquid reservoir section is provided a liquid discharge port from which liquid is discharged externally.

7. The multistage bath condenser-reboiler according to claim 1, wherein the liquid reservoir sections are open, and the evaporator further comprises a gas collection vessel which collects evaporated gas that flows out into the liquid reservoir sections.

8. The multistage bath condenser-reboiler according to claim 1, wherein the liquid reservoir sections are provided on both sides in a width direction of the heat exchanger core.

9. The multistage bath condenser-reboiler according to claim 1, wherein the liquid communication passages are provided on both side surfaces in a stacking height direction of the heat exchanger core.

* * * * *